US005383272A

United States Patent [19]

Mattingly et al.

[11] Patent Number: 5,383,272

[45] Date of Patent: Jan. 24, 1995

[54] ELECTRICAL CONNECTOR SHELL REINFORCEMENT MEANS AND METHOD OF FABRICATING SAME

[75] Inventors: William R. Mattingly, Santa Ana; Michael Blum, Hesperia; Christopher Nasser, Fontana, all of Calif.

[73] Assignee: Matrix Science Corporation, Torrance, Calif.

[21] Appl. No.: 139,235

[22] Filed: Oct. 19, 1993

Related U.S. Application Data

[60] Division of Ser. No. 853,029, Mar. 18, 1992, Pat. No. 5,256,077, which is a continuation of Ser. No. 614,797, Nov. 14, 1990, abandoned.

[51] Int. Cl.[6] ..... H01R 9/54

[52] U.S. Cl. ..... 29/876; 439/314

[58] Field of Search ..... 439/312-321; 29/876; 285/396

[56] References Cited

U.S. PATENT DOCUMENTS

| | | | |
|---|---|---|---|
| D. 256,231 | 8/1980 | Laudig | D13/3 |
| 3,049,690 | 8/1962 | Sparber | 439/319 |
| 3,323,083 | 5/1967 | Ziegler, Jr. . | |
| 3,351,886 | 11/1967 | Zimmerman, Jr. . | |
| 3,901,574 | 8/1975 | Paullus et al. | 285/81 |
| 4,165,911 | 8/1979 | Laudig . | |
| 4,230,390 | 10/1980 | Wells | 439/314 |
| 4,305,180 | 12/1981 | Schwartz | 439/314 |
| 4,361,374 | 11/1982 | Marmillion | 439/314 |
| 4,367,002 | 1/1983 | Waghorn | 439/314 |
| 4,443,052 | 4/1984 | Eaby et al. . | |
| 4,483,579 | 11/1984 | Derr et al. | 439/607 |

*Primary Examiner*—Eugene F. Desmond

*Attorney, Agent, or Firm*—Robbins, Berliner & Carson

[57] ABSTRACT

An electrical connector shell reinforcement means operable to support and strengthen the bayonet pins of the electrical connector is disclosed. The electrical connector shell reinforcement means includes a metal band bonded upon the electrical connector shell before or after the insertion of the bayonet pins. The shell reinforcement means provides structural support against the shearing forces the pins are subjected to. An alternative embodiment of the electrical connector reinforcement means incorporates a washer-like metal band directly supporting the bayonet pins of the electrical connector shell. An alternative embodiment of the electrical connector reinforcement means incorporates a metal cup on the composite material molded into the bayonet pin. Finally, a coupling ring is disclosed to be formed of plastic or composite material to include a metal liner therewithin having a bayonet pin receiving groove cut or broached into its inside surface, and a method of producing such device is also disclosed.

2 Claims, 4 Drawing Sheets

FIG. 1
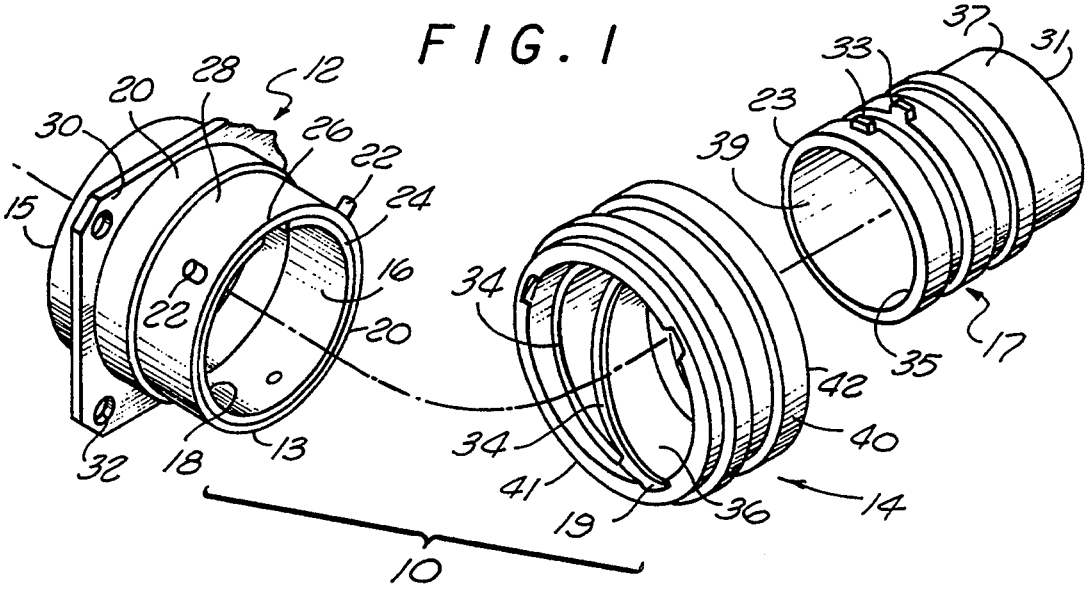
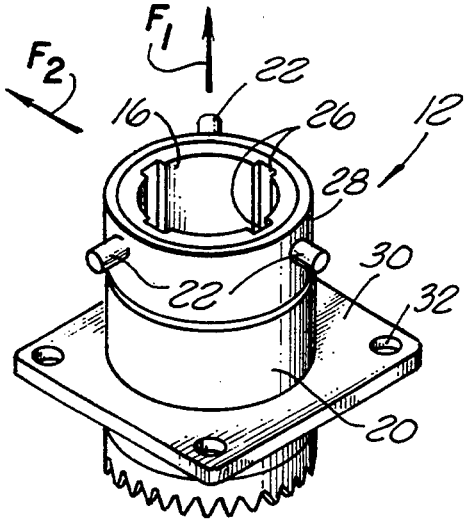
FIG. 2A
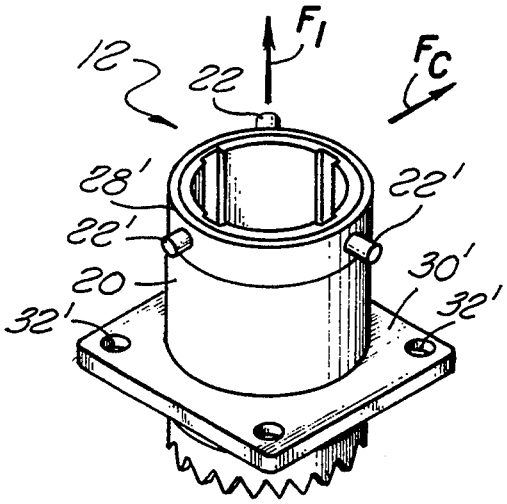
FIG. 2B
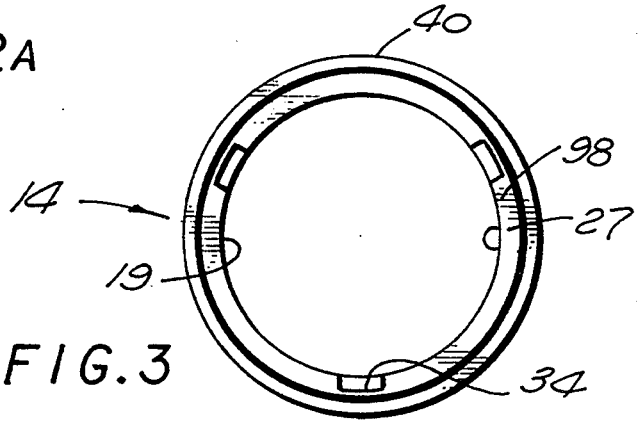
FIG. 3

FIG. 4
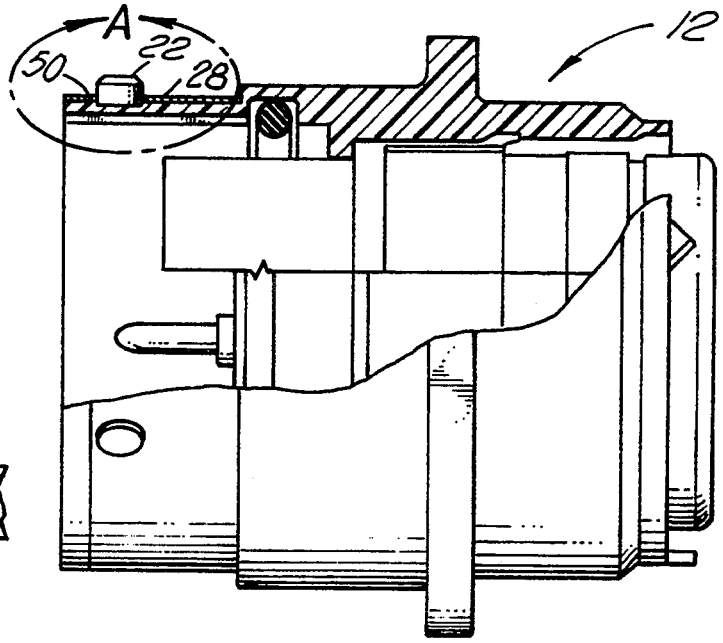
FIG. 4A
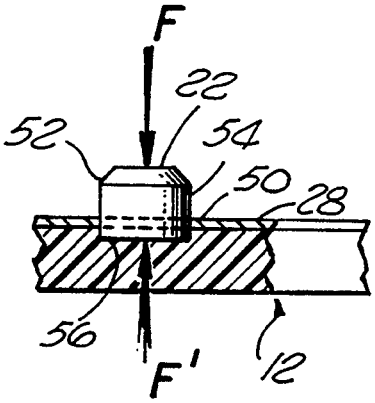
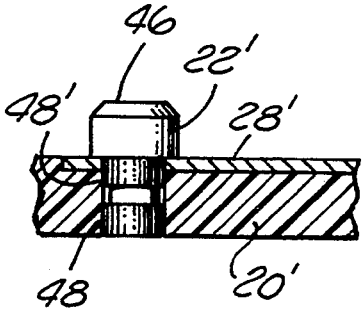
FIG. 5A
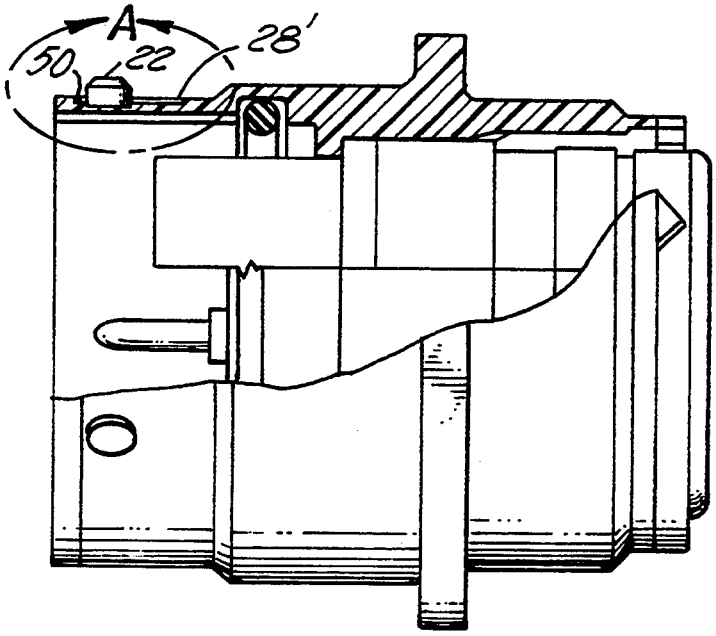
FIG. 5

FIG. 6A
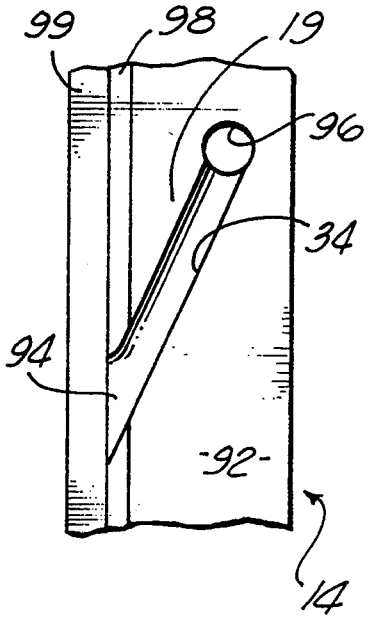
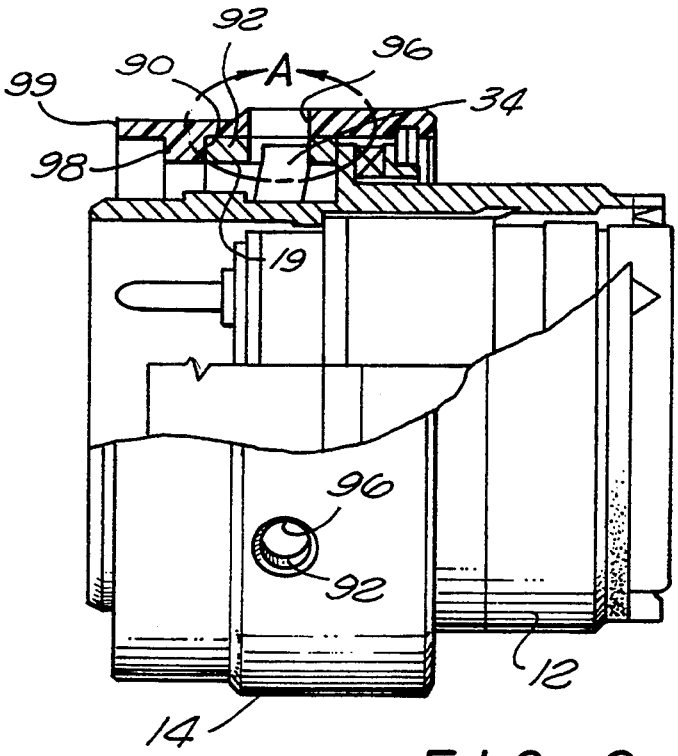
FIG. 6
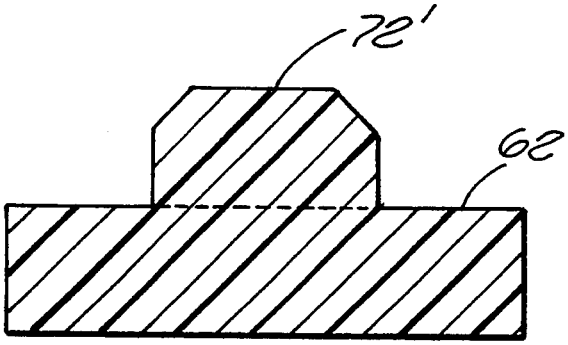
FIG. 8
FIG. 9
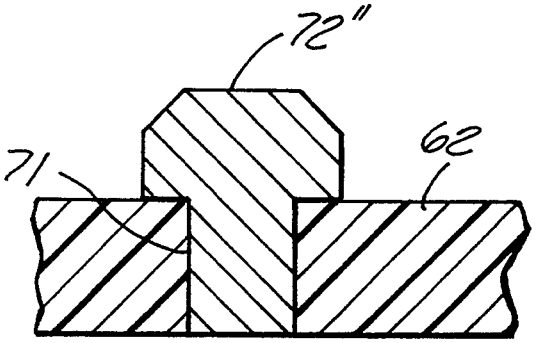

FIG. 7A
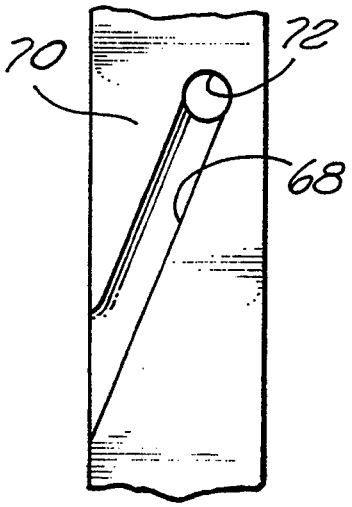
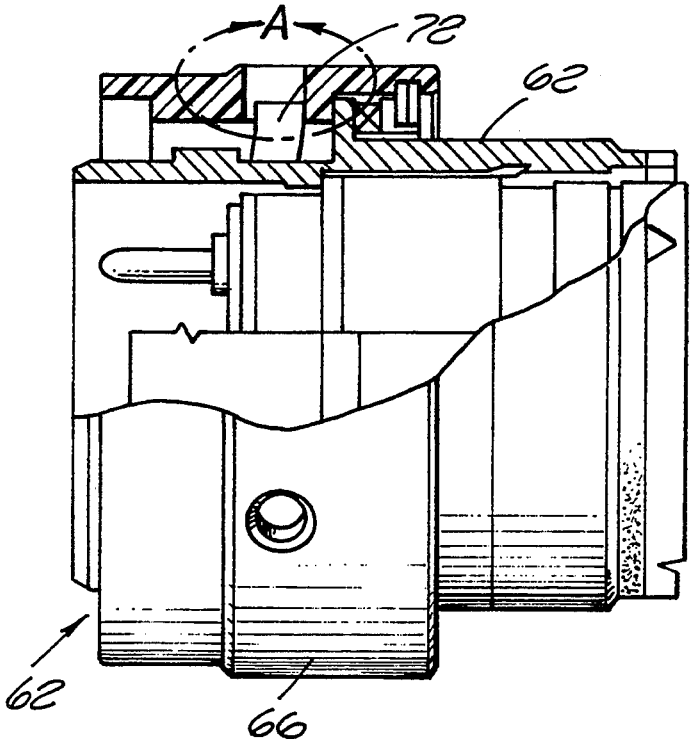
FIG. 7
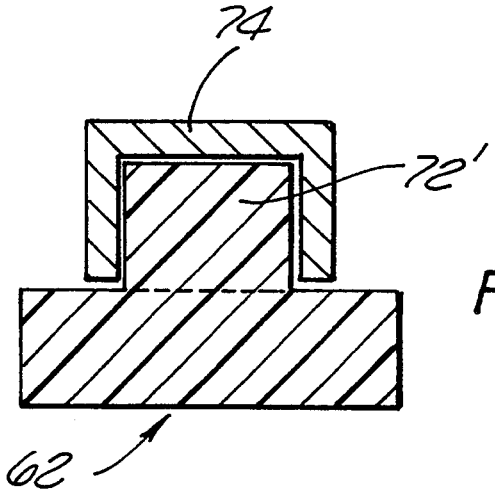
FIG. 10
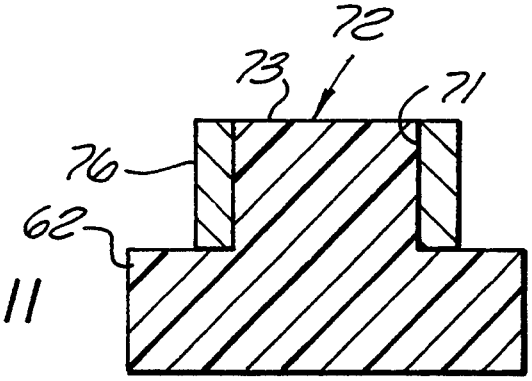
FIG. 11

ELECTRICAL CONNECTOR SHELL REINFORCEMENT MEANS AND METHOD OF FABRICATING SAME

RELATED APPLICATION

This application is a divisional application of copending application Ser. No. 07/853,029, filed Mar. 18, 1992, issued as U.S. Pat. No. 5,256,077, which in turn is a continuation application of prior application Ser. No. 07/614,797, filed Nov. 14, 1990, now abandoned.

BACKGROUND OF THE INVENTION

The present invention relates to an electrical shell connector reinforcement means and more particularly to a reinforcement means which structurally supports the bayonet pins and bayonet grooves of the electrical connector shell and coupling ring, respectively.

Electrical connectors for the coupling of electrical cables having multiple terminations such as individual leads, are well known. Such multi-lead connectors are used in electronic systems to electrically couple the individual components from those systems together. In, for example, aircraft systems, military vehicles and the like, these connectors must operate in a high degree of reliability. They must not fail in severe climatic, vibrational, or electrical interference environments. Unfortunately, despite the many types of connector designs now available, connectors are still subject to failures due to these factors. A failure of the individual electrical connector can result in the failure of an entire electrical system.

To address these failure problems, various programs have been initiated to implement retrofits which prevent failures before they happen. It is still, however, an object of the art to obtain a connector which would have increased reliability and decreased failure rate due to stress forces, vibration, climatic conditions or environmental changes, all providing a high degree of electromagnetic shielding.

Bayonet connectors which incorporate a first electrical connector shell having bayonet pins implemented upon the exterior surface of the first connector shell operable to slidably interfit a second cylindrical electrical connector shell and further to be coupled incorporating a coupling ring which is operable to receive the bayonet pins of the first cylindrical connector shell, are well known.

In the bayonet electrical shell connector configuration, the greatest stress forces to which the exterior surface of the first connector shell are subjected, occurs at the stress points behind the bayonet pins. Further, the interaction of the environment incorporating vibrational stresses, temperature changes and the like produce the potential for failure due to these forces as they act upon the individual bayonet pins which are slidably interconnected within the bayonet grooves lining the interior surface of the coupling ring.

The weakest portion of the first connector shell is the surface directly beneath the bayonet pins. In, for example, a first electrical connector shell formulated of a composite material, the metal pins may be, for example, ball-peened into place and the area directly surrounding them would be a composite interacting with their metal nature. Alternately, the bayonet pins when comprised of a composite material may be molded into place or pressed into the composite connector shell after fabrication of the shell.

It would be advantageous to provide additional mechanical support to the bayonet pins without enlarging their size or changing their chemical composition.

Further, it would be advantageous to strengthen the overall annular mating of the first connector shell and the second connector shell through the coupling ring by the incorporation of reinforced bayonet grooves without radically changing the size or configuration of the standard coupling ring.

It is therefore an objective of the art to obtain a connector which has an increased immunity to stress failure as a result of vibration, environmental conditions or physical abuse while providing an improved degree of electromagnetic shielding.

SUMMARY OF THE INVENTION

An electrical connector in accordance with this invention includes a first shell having an annular radially disposed sealing surface which has upon the outer surface of the first shell at least one mechanically reinforced bayonet pin, a second shell for being coupled to the first shell and a coupling ring incorporating at least one bayonet groove operable to slidably interfit over the mated first shell and second shell.

In accordance with the present invention, the bayonet pin is mounted upon a metal ring which completely encircles the outer surface of the first shell. Further, the coupling ring incorporates metal ramps within the bayonet grooves operable to structurally support the mechanically reinforced bayonet pins of the first shell. Thus, when the first and second shells are coupled together within the augmented coupling ring, and are in a mating relationship, the metal reinforced bayonet pins slidably interfit the standard bayonet groove or the augmented bayonet ramp of metal reinforcement providing a continuous metal-to-metal annular seal between the first and second shells.

In accordance with the invention, an alternative embodiment incorporates a metal washer completely encircling a limited exterior surface of one end of the first shell directly mechanically supporting the bayonet pins of the electrical connector.

A second alternative embodiment incorporates a metal cup completely covering the molded-in or pressed-in composite bayonet pin.

A third alternative embodiment incorporates a metal cylinder encircling the molded-in or pressed-in composite bayonet pin.

A method is disclosed for fabrication for the complete metal band molded upon the composite shell, the metal washer molded upon a limited exterior surface of the end of the shell, the metal cup completely covering the individual pin and, the metal cylinder surrounding the bayonet pin. Also disclosed is a method of fabrication, and the metal bayonet ramps within the coupling ring by providing a plastic or composite coupling ring body around a metal member defining an inner metal liner into which the pin-receiving groove is broached.

BRIEF DESCRIPTION OF THE DRAWINGS

A complete understanding of the present invention and of the above advantages may be gained from a consideration of the following description of the preferred embodiments taken in conjunction with accompanied drawings in which:

FIG. 1 is a schematic representation exploded view of a bayonet connector having structural reinforcement of the bayonet pins and metal ramp lining the bayonet groove;

FIG. 2A is a schematic representation perspective view of one embodiment of the bayonet pin reinforcement having a full metal sleeve;

FIG. 2B is a schematic representation perspective view of another embodiment of the bayonet pin reinforcement as a washer sleeve;

FIG. 3 is a schematic representation top view of the coupling ring with reinforced bayonet ramp;

FIG. 4 is a schematic representation partial cross sectional view of a bayonet connector having a mechanical metal reinforcement surrounding the bayonet pin;

FIG. 4A is a schematic representation partial cross sectional view of the structurally reinforced bayonet pin;

FIG. 5 is a schematic representation partial cross sectional view of an alternative bayonet pin reinforcement means;

FIG. 5A is a schematic representation partial cross sectional view of the bayonet pin reinforcement means incorporating a countersink pin;

FIG. 6 is a schematic representation partial cross sectional view of the bayonet connector having reinforced ramps within the coupling ring;

FIG. 6A is a partial schematic representation elevational view of the Area A of FIG. 6 of the ramp within the coupling ring.

FIG. 7 is a schematic representation partial cross sectional view of the bayonet connector fabricated completely of composite material;

FIG. 7A is a partial schematic representation elevational view of the Area A of FIG. 7 of the non-metal composite ramp within the coupling ring;

FIG. 8 is a schematic representation cross sectional view of a molded-in bayonet pin fabricated of composite material;

FIG. 9 is a schematic representation cross-sectional view of a metal pressed-in pin;

FIG. 10 is a schematic representation cross sectional view of a metal cup surrounding a molded-in composite bayonet pin; and FIG. 11 is a schematic representation cross sectional view of a metal cylinder surrounding a molded-in composite bayonet pin.

DETAILED DESCRIPTION OF THE PREFERRED EMBODIMENT

The invention, an electrical connector having a reinforced bayonet pin includes a first shell comprised of a composite material which has a complete band of metal molded about the exterior surface thereof. Holes are then drilled within the shell through the metal band and into the composite material wherein bayonet pins are ball-peened to secure them in place. This reinforcement of the exterior surface of the first shell directly beneath the bayonet pins, provides increased structural support against the stress forces which the connector experiences from its environment.

An alternative embodiment lines the bayonet grooves within the interior surface of the coupling ring with metal wherein the metal supported bayonet pins of the exterior surface of the first shell slidably interfit within a metal ramp reinforced bayonet groove.

It is also desirous to manufacture the invention disclosed incorporating a thin washer encircling the first end of the first shell directly beneath the bayonet pins. This alternative embodiment provides additional strength for the weakest part of the first shell, the area directly beneath the bayonet pins. During full mating, an annular metal-to-metal seal is thereby formed between the first shell, the second shell and the coupling ring.

It is further desirous to manufacture the connector completely of composite material having molded-in or pressed-in composite or metal bayonet pins. These pins are individually capped with metal or surrounded by metal cylinders. These mechanical supports to the molded-in or pressed-in bayonet pins are used with composite ramps that have metal structural supports. In the alternative, the metal augmented bayonet pins are used with composite ramps.

FIG. 1 is a schematic representation exploded view of a bayonet connector 10 having a first shell 12, second shell 17 and coupling ring 14 with shell reinforcement means 28 supporting the bayonet pins 22 as well as a bayonet groove ramp 34 incorporated within the coupling ring 14. First electrical connector cylindrical shell 12 having a first end 13 and a second end 15, comprises a composite material body such as for example, fiberglass fibers embedded within a polyethylethylketone (PEEK) resin. Shell 12 having interior surface 18, exterior surface 20, and central cylindrical space 16 is operable, although not shown here, to incorporate a multi-pin insert to facilitate the transmittal of electrical signals within and through the connector 10 for a multitude of leads.

As shown in FIG. 1, a metal reinforcement means 28 fully encircles the exterior surface 20 of the first shell 12. This metal reinforcement means 28 has holes cut within its surface through the composite material to receive the bayonet pins 22. These bayonet pins 22 can, for example, be ball-peened and secured into place after the metal reinforcement means 28 is mounted about the composite material of shell 12. An annular sealing surface 24 is then formed from the combination of the composite material of the shell 12 and the metal reinforcement means 28. The wall mounting flange means 30 also of a composite material is shown with its securing orifices 32.

The second shell 17 of FIG. 1 has a first end 23 and a second end 31. Keys 33 protruding from shell 17 serve as alignment means by slidably interfitting the key way 26 cut within the interior surface 18 of the first shell 12. Second connector shell 17 has interior surface 35, exterior surface 37 and central cylindrical space 39. Although not shown here, the central cylindrical space 39 for the second cylindrical connector shell 17 receives an insert having a multiplicity of pin leads such that the insert of the second connector shell 17 can fully mate with the insert of the first shell 12.

Also shown in FIG. 1, coupling ring 14 receives as both slidably mate, first shell 12 and second shell 17. The interior surface 19 of the coupling ring 14 is provided with an in situ molded metal liner retained within the plastic which liner is then grooved or broached forming bayonet grooves 34 which are operable to slidably secure the bayonet pins 22 of the first shell 12. Coupling ring 14 has interior surface 19, exterior surface 40, and inner space 36. This inner space 36 slidably receives and lockingly secures by bayonet pins 22 the mated first and second shells 12 and 17, respectively. During mating engagement, coupling ring 14 first end 41 receives first end 13 of first shell 12 while coupling ring 14 second end 42 also slidably receives the first end 23 of the second connector shell 17.

FIG. 2A is a schematic representation perspective view of one embodiment of the bayonet pin reinforcement means having a full metal reinforcement means in the form of sleeve 28. The metal sleeve 28 fully encircles the composite material of the exterior surface 20 of the first shell 12. Forces, such as F1, which is perpendicular to the bayonet pins 22 and F2 which is parallel to the pins 22 tend to be absorbed by the increased structural support of the metal bayonet pin reinforcement means 28. Shell 12 also includes wall mounting flange means 30 with securing orifices 32.

FIG. 2B is a schematic representation perspective view of another embodiment of the bayonet pin reinforcement means which incorporates a washer sleeve 28' upon the surface 20 of the composite material. In this embodiment, the washer sleeve 28' directly supports the bayonet pins 22. This alternative embodiment again has a wall mounted flange 30 which is operable to be bolted to a wall through securing orifices 32. First shell 12' forces F1 and F2, perpendicular and parallel, respectively to the bayonet pins 22' and subjects the bayonet pins 22' to stress which tends to be absorbed by sleeve 28'. Wall mounted flange means 30' and securing orifices 32' mount the shell 12' to the wall, not shown in this example.

FIG. 3 is a schematic representation top view of the coupling ring 14 with reinforced bayonet ramp. The coupling ring 14 includes two distinct layers. The bayonet grooves 34 extend rearwardly from entrances seen through flange 98 and into metal insert 27 disposed behind flange 98 (see FIGS. 6 and 6A. Metal insert 27 provides additional structural support for bayonet pins 22 while incorporating improved electromagnetic interference protection for the overall electrical connector.

FIG. 4 is a schematic representation partial cross sectional view of shell 12 having a mechanical metal reinforcement means 28 surrounding the ball-peened bayonet pin 22. In this cross section, first shell 12 has mounted the full width of its outer surface a metal band 28. After the metal reinforcement means 28 has been mounted on shell 12, holes 50 are drilled into both the means 28 and shell 12. Shell 12, which has been predrilled, has bayonet pin 22 ball peened into place.

FIG. 4A is a partial schematic representation cross sectional view of the structurally reinforced bayonet pin 22 of the area A as shown in FIG. 4. Pin 22 is mounted within a pin hole 50 drilled within the metal surface 28 of the first shell 12. The pin 22 has a head 52, a shank 54 and base 56. When force F is applied to pin 22 during its mounting into the hole 50, the shank 54 expands within the pre-drilled or molded hole 50. A counter force, F' is applied to the base 56 of the pin 22 during mounting by for example, pliers.

FIG. 5 is a schematic representation partial cross sectional view of an alternative embodiment bayonet pin reinforcement means 28 incorporating metal ring 28' encircling the composite first shell 12 with a pin 22' which has been mounted through hole 50 in the metal ring 28' wherein the pin 22' has ratchets which facilitate the molding in of the composite pins.

FIG. 5A is a partial schematic representation cross sectional view of the bayonet reinforcement means 28 area A of FIG. 5 surrounding the bayonet pin 22'. Specifically, the bayonet pin 22' is shown mounted within hole 50 which has been pre-drilled or molded within the composite material 20' beneath metal ring 28'. The bayonet pin 22' which is either metal or composite material, is secured by two knurled sections 48, 48', which reinforce the capability of the pin 22' to remain within the composite shell 12' as mounted within the metal ring 28'.

FIG. 6 is a schematic representation partial cross sectional view of the coupling ring 14 and first shell 12. The coupling ring 14 for this example is fabricated of composite material and has disposed within an annular recess 90 formed behind a leading annular flange 98 which is filled by a metal layer or liner 92 defining an inwardly facing surface 19 and partially into which a groove 34 is cut or broached from a pin-receiving entrance 94 near leading end 99 and extending helically to a pin-receiving detent 96. Groove 34 (see FIG. 6A below) is thereby reinforced having a bottom surface and side wall surfaces formed by the metal liner 92 wherein the bayonet pin shown elsewhere, slidably interfits.

FIG. 6A is a partial schematic representation elevational view of the area A of FIG. 6 of the groove 34 which has been broached within the metal liner providing the bayonet pin support wherein the pin resides slidably within groove 34 which has been cut within the metal within the interior surface 19 of the coupling ring 14 extending from flange 98 spaced inwardly from coupling ring leading end 99. Alternative connector 10 embodiments would incorporate metal reinforced bayonet pins and unreinforced coupling rings 14 which do not have grooves 34 broached within the metal liners.

The metal portions recommended as reinforcement support means for the bayonet pins in all embodiments, could be either assembled or molded in place. The incorporation of a metal support surrounding the bayonet pins as they matingly engage the coupling ring, resolves the long-held problem within the industry of stress shearing and fracturing about the bayonet pins of bayonet couplers.

The complete band of metal encircling the thin portion of the first connector shell, can be incorporated after the plastic of the composite material has been molded. Drilling of the holes which allow the incorporation of the bayonet pins through a ball peening process can then be completed. An additional concept of molding a thin metal washer in situ and brazing the pins into place prior to molding is also disclosed.

FIG. 7 is a schematic representation partial cross sectional view of two elements of the bayonet connector fabricated completely of composite material. Specifically, the coupling ring 66 is fabricated of a composite material. In this embodiment, the ramps or grooves 72 of the coupling ring are of a composite material and are not lined with metal forming metal ramps. First shell 62 is shown secured by coupling ring 66. Bayonet grooves 72 are broached into the interior surface of the coupling ring 66.

FIG. 7A is a partial schematic representation elevational view of the Area A of FIG. 7 of the non-metal composite ramp within the coupling ring. Should a metal ramp be desired within the coupling ring 66 of a composite connector 6, the ramps or grooves are molded-in during fabrication by being inserted with the interior surface of the coupling ring during molding. The same metal ramp may be inserted after fabrication by being pressed-in within the already configured composite ramps 68.

FIG. 8 is a schematic representation cross sectional view of a molded-in bayonet pin fabricated of composite material. The bayonet pin 72′ which in this example is molded into the exterior surface of the first connector shell 62 has no additional mechanical support surrounding the pin 72′. This pin 72′ may be used within a metal reinforced groove within the interior surface of a coupling ring.

FIG. 9 is a schematic representation cross sectional view of a metal pressed-in bayonet pin 72″ mounted within a hole 71 which has been drilled through composite material first shell 62. This embodiment is an alternative to the molded-in composite bayonet pin 71′ more clearly shown in FIG. 8. And, metal pressed in bayonet pin 72″ is used within metal or non-metal reinforced coupling rings.

FIG. 10 is a schematic representation cross sectional view of a metal cup surrounding a molded-in composite bayonet pin. This is an alternative way to reinforce the bayonet pin without encircling the first shell. The metal cup 74 provides a mechanical support for the molded-in pin 72′. The metal cup 74 completely surrounds the pin 72′ and provides mechanical structural support for the pin 72′ which can be used within a metal augmented ramp in a coupling ring or within a non-metal composite ramp.

FIG. 11 is a schematic representation cross sectional view of a metal cylinder surrounding a molded-in composite bayonet pin, and is yet another bayonet pin reinforcement means. The composite molded-in bayonet pin 72′ resides projection-like upon the surface of the first shell. Metal cylinder 76 surrounds the shank 71 of the pin 72′ while leaving the head 73 of the pin 72′ exposed. Mechanical support is provided to the composite bayonet pin 72′ structure. The metal cylinder 76 can be molded-in during manufacture of the pin itself or it can be attached later surrounding the bayonet pin 72′.

While particular embodiments of the invention have been shown and described, it will be obvious to those skilled in the art that changes and modifications may be made without departing from the invention in its broader aspects and therefore the aim in the appended claims is to cover all such changes and modifications as followed in the true spirit and scope of the invention.

What is claimed:

1. A method of providing a composite material electrical connector, said method comprising the steps of:

providing a first shell formed of composite material and having a first and second end, said first shell having cooperatively associated with at least one bayonet pin, a metal cup, said first shell containing within the interior surface of said first shell an alignment receptacle means;

providing a second shell formed of composite material and having upon the exterior surface of said second shell an alignment key means operable to slidably interfit said alignment receptacle means of said first shell; and providing a coupling ring comprising:

a coupling ring body formed of composite material and having an interior and an exterior surface;

a metal layer formed along said interior surface by molding said coupling ring body along the outside surface of a previously formed ungrooved metal member;

forming at least one interior surface annular groove defined into said metal layer and having bottom and side wall surfaces defined by said metal layer, said groove being thereby reinforced;

said coupling ring operable to cooperatively associate with and interfittingly lock said first shell bayonet pin and when said first shell and said second shell are matingly engaged, said groove extending helically from a pin-receiving entrance to a pin-receiving detent to receive thereinto and slidably therealong a said bayonet pin of said first shell.

2. A method of providing a composite material electrical connector, said method comprising the steps of:

providing a first shell formed of composite material and having a first and second end, said first shell being cooperatively associated with at least one bayonet pin, said bayonet pin being surrounded by a cylindrical metal band, said first shell containing within the interior surface of said first shell an alignment receptacle means;

providing a second shell formed of composite material and having upon the exterior surface of said second shell an alignment key means operable to slidably interfit said alignment receptacle means of said first connector shell; and providing a coupling ring comprising:

a coupling ring body formed of composite material and having an interior and an exterior surface;

a metal layer formed along said interior surface by molding said coupling ring body along the outside surface of a previously formed ungrooved metal member;

forming at least one interior surface annular groove defined into said metal layer and having bottom and side wall surfaces defined by said metal layer, said groove being thereby reinforced;

said coupling ring operable to cooperatively associate with and interfittingly lock said first shell bayonet pin and when said first shell and said second shell are matingly engaged, said groove extending helically from a pin-receiving entrance to a pin-receiving aperture to receive thereinto and slidably therealong a said bayonet pin of said first shell.

* * * * *